US007061350B2

(12) United States Patent
Schneider et al.

(10) Patent No.: US 7,061,350 B2
(45) Date of Patent: Jun. 13, 2006

(54) ELECTROMAGNETIC RELAY WITH A TRIPLE CONTACT BRIDGE

(75) Inventors: Axel Schneider, Berlin (DE); Titus Ziegler, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 12 days.

(21) Appl. No.: 10/499,272

(22) PCT Filed: Dec. 6, 2002

(86) PCT No.: PCT/EP02/13867

§ 371 (c)(1),
(2), (4) Date: May 3, 2005

(87) PCT Pub. No.: WO03/052783

PCT Pub. Date: Jun. 26, 2003

(65) Prior Publication Data

US 2005/0219018 A1 Oct. 6, 2005

(30) Foreign Application Priority Data

Dec. 18, 2001 (EP) ..... 01130103

(51) Int. Cl.
*H01H 51/22* (2006.01)

(52) U.S. Cl. ..... 335/78; 335/83; 335/106; 335/130; 335/133; 335/196; 200/243; 200/250; 200/283

(58) Field of Classification Search ..... 335/78–86, 335/83, 106, 127–130, 133–135, 185, 192, 335/196–200; 200/243, 245, 246, 250, 283
See application file for complete search history.

(56) References Cited

U.S. PATENT DOCUMENTS

| | | | | |
|---|---|---|---|---|
| 1,085,810 | A | 2/1914 | Hoge | |
| 4,683,358 | A * | 7/1987 | Dittmann | 200/243 |
| 6,608,542 | B1 * | 8/2003 | Pietsch et al. | 335/274 |

FOREIGN PATENT DOCUMENTS

| | | |
|---|---|---|
| FR | 935 271 | 6/1948 |
| WO | WO 00/38207 | 6/2000 |

* cited by examiner

*Primary Examiner*—Ramon M. Barrera
(74) *Attorney, Agent, or Firm*—Seed IP Law Group PLLC

(57) ABSTRACT

The invention relates to an electromagnetic relay with an electromagnetic coil for exciting a magnetic field and an iron circuit for guiding the magnetic field, wherein the electromagnetic coil surrounds at least part of the iron circuit and the iron circuit comprises a core, a movable armature and a yoke. The electromagnetic relay further comprises a contact system with a movable contact bridge which can be actuated dependent on the magnetic field. In order to provide an electromagnetic relay that is able to disconnect or connect a plurality of electric contacts simultaneously in a particularly secure and loss reduced manner, according to the present invention there are provided at least three electric contacts on the contact bridge. According to an advantageous embodiment, the contact system comprises three fixed contacts which are corresponding each to one of three phases and the contact bridge forms a star point of the three phases.

27 Claims, 4 Drawing Sheets

ELECTROMAGNETIC RELAY WITH A TRIPLE CONTACT BRIDGE

BACKGROUND OF THE INVENTION

1. Field of the Invention

The invention generally relates to electromagnetic relays and to contact systems therefore and, in particular, to electromagnetic relays for switching multiple contacts.

2. Description of the Related Art

Presently, several techniques have been developed for electromagnetic relays, which are generally adopted to close or open one or more electric circuits by means of electric control voltages and are used in the following application areas:

- switching of high power controlled by low power,
- separating different voltage levels, for instance low voltage at the input side and mains voltage at the output side,
- separating DC and AC circuits,
- simultaneous switching of several circuits by means of one single control signal,
- linking of information and thereby building up control sequences.

In particular, in the area of automotive electronics, relays are used for various switching tasks. The efforts of the automobile industry to replace conventional systems, as for instance the hydraulic steering support, by electric systems, require switches, which can switch off the employed three phase motors in case of a failure securely. A such like switch for disconnecting and connecting a star point of a three phase motor (e.g. For 12 V and 42 V on-board supply systems in a current range of more than 40 A and 15 A, respectively) can conventionally be realized by means of conventional relays, as shown schematically in the FIGS. 8 to 10 by interconnecting one form-U relay (FIG. 9) or two form-A (FIG. 8) or form-X contact pairs (FIG. 10). This nomenclature is in accordance with the symbols of the American National Standard Institute, ANSI. Known electromagnetic relays which have contact bridges with two movable contacts each, are disclosed for instance in the U.S. Pat. No. 5,151,675 (Bier et al.) And U.S. Pat. No. 4,540,963 (Ester et al.).

However, because the dissipation power augments with the square of the current, with such conventional realizations, wherein normally open contacts with a center tap, or different normally open relays are interconnected, occur unduly high dissipation power values. A use of conventional high current relays, however, involves the disadvantage of significantly higher costs, size and weight.

SUMMARY OF THE INVENTION

An improved electromagnetic relay and a contact system are provided, wherein a plurality of electric contacts may be simultaneously disconnected or connected with reduced losses and enhance security.

According to one embodiment, an electromagnetic relay is provided, which comprises an electromagnetic coil for exciting a magnetic field, a ferromagnetic circuit for guiding the magnetic field, wherein the magnetic coil encompasses at least a part of the ferromagnetic circuit and wherein the ferromagnetic circuit comprises a core, a movable armature and a yoke. Moreover, the electromagnetic relay comprises a contact system with a movable contact bridge which can be actuated dependent on the magnetic field, wherein at least three electric contacts are arranged on the contact bridge.

In another embodiment, a contact system an electromagnetic relay with a movable contact bridge, which can be actuated dependent on a magnetic system, may be provided, wherein at least three electric contacts are arranged on the contact bridge.

BRIEF DESCRIPTION OF THE DRAWINGS

The accompanying drawings are incorporated into and form a part of the specification for the purpose of explaining the principles of the invention. The drawings are not to be construed as limiting the invention to only the illustrated and described examples of how the invention can be made and used. Further features and advantages will become apparent from the following and more particular description of the invention is illustrated in the accompanying drawings, wherein.

DETAILED DESCRIPTION OF THE INVENTION

The illustrated embodiments of the present invention will be described with reference to the figure drawings wherein like elements and structures are indicated by like reference numbers.

Figure 1:
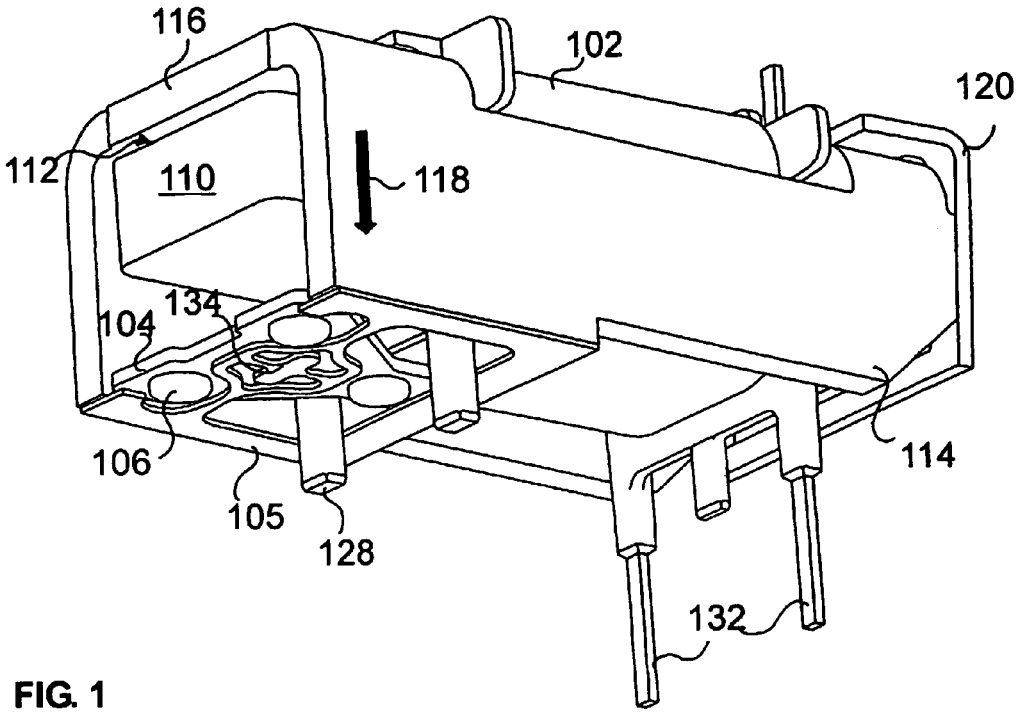
FIG. 1 shows a perspective view of magnetic system of an electromagnetic relay and movable contacts according to a first advantageous embodiment.
Figure 2:
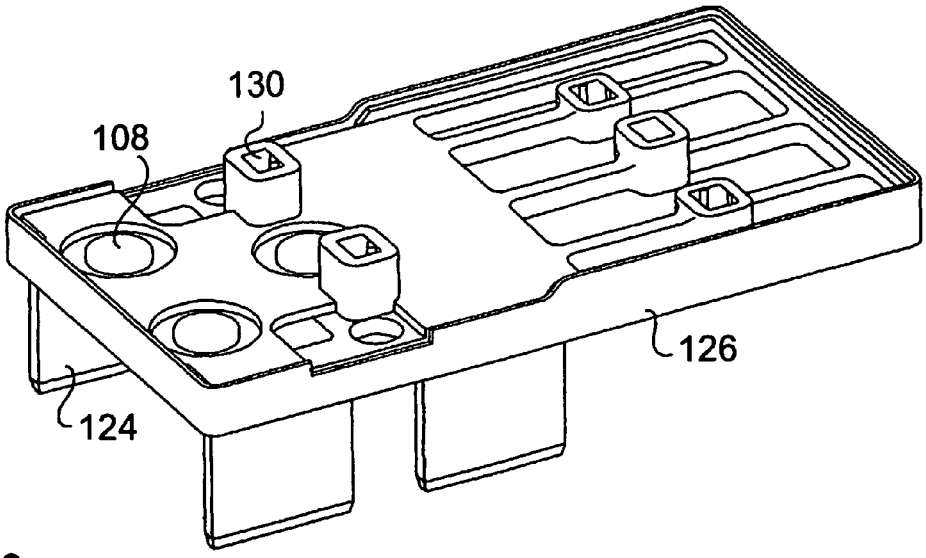
FIG. 2 shows a perspective view of a belonging base plate having respective fixed contacts.

Referring now to the drawings and in particular FIG. 1, a partial component of the relay according to one embodiment is shown in a perspective view, which comprises the magnetic system consisting of a magnetic coil and the iron circuit as well as the movable contacts. According to this embodiment, the movable contact bridge 104 has three electric contacts 106. Same disconnect or connect with one single movement the connection to corresponding fixed contacts 108 which are shown in FIG. 2. Each of the fixed contacts 108 corresponds to one phase of a three phase motor. Thus, the contact bridge 104 forms the star point of three phases. The longitudinal leg of a T-shaped core extends axially through the magnetic coil 102. The two transversal legs form a pole face 112. According to this embodiment, the armature and the yoke are integrated in a U-shaped movable armature 114 having a basal plane 116. If the magnetic coil is energized by an electric current, a magnetic field is established, which causes an attraction of the movable armature 114 to the pole face 112 of the core 110. At the side legs of the U-shaped armature 114 the contact bridge 104 is fixed and is moved due to this movement of the armature 114 in the direction 118 to the fixed contacts 108. A reset spring 120 which is provided at the support of the armature 114 causes the armature 114 to move back in a direction opposite to the area 118, as soon as the magnetic coil 102 is no longer energized by the current.

Via the connections 124, which are led outwards at the underside of the bottom part 126, the respective phases can be connected to the fixed contacts 108. The assembly of the components shown in FIGS. 1 and 2 is facilitated by providing positioning pins 128, which interact with corresponding openings 130 arranged at the bottom part 126. The contact pins 132 for contacting the magnetic coil 102 pass through the bottom part 126 after assembly and are accessible from the bottom side for an electric connection of the magnetic coil 104.

The contact bridge 104 is connected to the moveable armature 114 via a contact spring 105 for actuation. According to the principle of a bilaterally fixed cantilever, this contact spring 105 is connected at both side ends with one leg of the U-shaped armature 114 each. Generally, it is sufficient to provide only two sides of the three sided frame structure shown in this FIG. In the middle of the spring there is provided a fixing point 134 for the contact bridge 104. The contact bridge 104 is fixed on the contact spring 105 in a manner, that the latter is arranged between the contact bridge 104 and the fixed contacts 108. When opening the electric connection between the electric contacts 106 and the fixed contacts 108, the contact bridge 104 is supported at three points by the contact spring 105 and is thereby provided with the necessary reset stiffness. When closing the electric contact, the contacts 106 pass through the contact spring 105.

Figure 3:
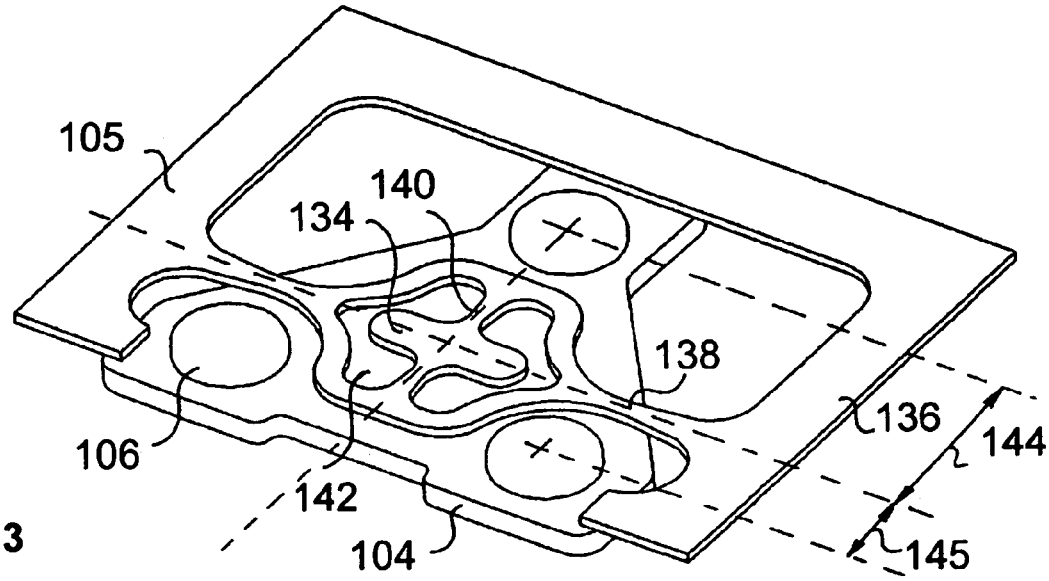
FIG. 3, is a perspective view of the contact spring and the contact bridge of FIG. 1.

The contact bridge 104 and the contact spring 105 are shown in detail in the perspective view of FIG. 3. The contact bridge 104 according to this embodiment has an essentially triangular form. The electric contacts 106 are arranged at the respective vertices and the contact spring 105 has an essentially rectangular form and can be produced for instance by punching from spring steel. The contact spring 105 has a frame 106 enclosing same at three sides, which can be connected with the armature at the two shorter sides. The resilient suspension of the contact bridge 104 is effected by two orthogonal torsion webs 138 and 140 which are extending in one plane. In the middle of torsion web 140 the fixing point 134, whereto the contact bridge 104 for instance can be welded, is located. This second torsion web 140 is formed by openings 142, which are provided at a burdening in the middle of the torsion web 138.

Such a contact spring is characterized by a comparatively high spring stiffness in a direction of the movement for transmitting the contact forces. Moreover, the torsion webs, which are lying in one plane, represent swivel joints with a low mechanical resistance. By this means, approximately identical contact forces can be achieved independently of fabrication tolerances or the contact burning during operation. By changing the geometric dimensions of the torsion webs 138 and 140, the stiffness of these swivel joints can be adjusted. The contact bridge 104 is fixed in its fixing point 134 at the intersection point of the two torsion axes. The contacts 106 are arranged in a manner, that one contact is lying on the axis of the second torsion web 140 and has a distance 144 to the first torsion web 138. The other two contacts are symmetric with respect to the torsion web 140 and have distance 145 to the torsion web 138, which may be about half the distance 144.

In the present embodiment, the frame 136 is closed only at three sides, in order to allow the passing through of the contacts 106. Also, it would be sufficient to provide only two webs at opposing sides of the rectangular frame 136.

Figure 6:
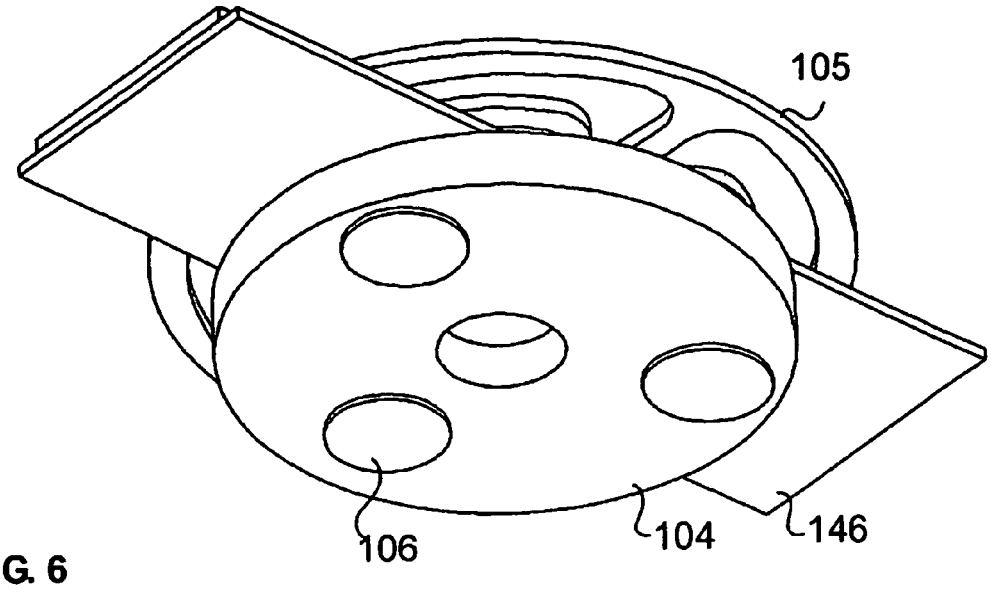
FIG. 6 is a perspective view of an arrangement consisting of a contact bridge, a flat form spring and a contact spring according to a third advantageous embodiment.
Figure 7:
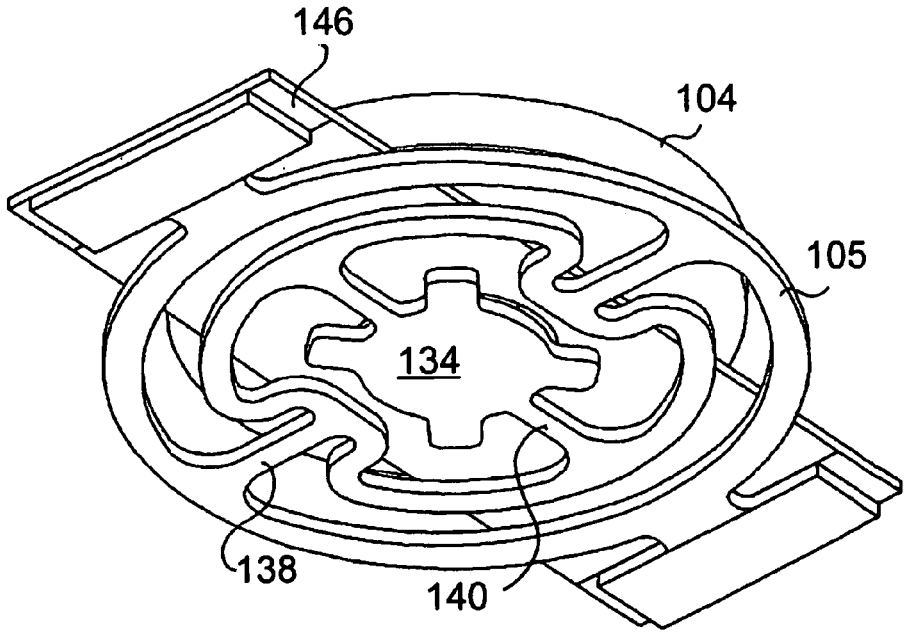
FIG. 7 is a perspective view of the arrangement of FIG. 6 turned by 180°.

Alternative embodiments are shown in the FIGS. 4 to 7. These embodiments have in common that the contact bridge 104 is not arranged between the core 110 and the contact spring 105, but between the contact spring 105 and the fixed contacts 108. These embodiments have the advantage that a high flexibility concerning the design of the contact spring 105 is possible, because no clear space has to be provided for the passing through of the electric contacts 106. The contact spring 105 can have essentially rectangular form with torsion webs (according to FIGS. 4 and 5) which are extending between the sides of the frame, or a circular form with radially arranged torsion webs (FIGS. 6 and 7).

In the embodiments of FIGS. 4 to 7, a flat form spring 146, which is provided between the contact bridge 104 and the contact spring 105, allows a deflection of the contact spring 105 only into one direction, thus, providing the necessary stiffness of the contact spring 105 in the case of a welding of the contacts when opening the moveable armature 114. Generally, the same effect can be achieved when the flat form spring 146 is not fixed between the contact bridge 104 in the contact spring 105, but at the contact spring 105 on the side which is facing the core 110.

Figure 8:
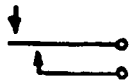
FIG. 8 Prior Art
FIG. 8 is a circuit diagram for a relay contact combination A according to the American National Standard Institute (ANSI)
Figure 9:
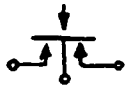
FIG. 9 Prior Art
FIG. 9 is a circuit diagram of a relay contact combination U according to ANSI.
Figure 10:
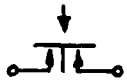
FIG. 10 Prior Art
FIG. 10 is a circuit diagram of a relay contact combination X according to ANSI.
Figure 4:
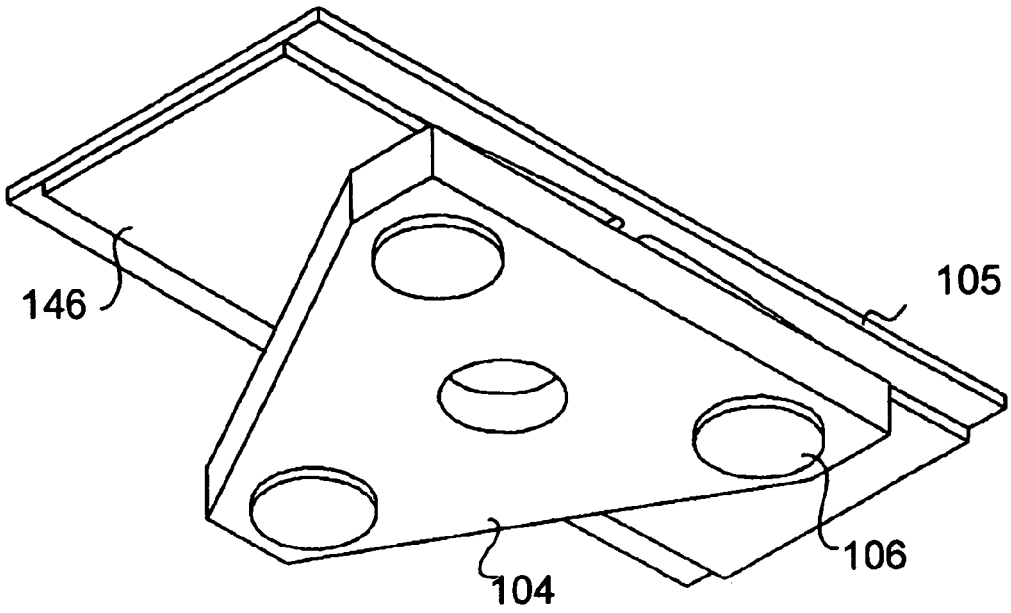
FIG. 4 is a perspective view of an arrangement consisting of a contact bridge, a flat form spring and contact spring according to another advantageous embodiment.
Figure 5:
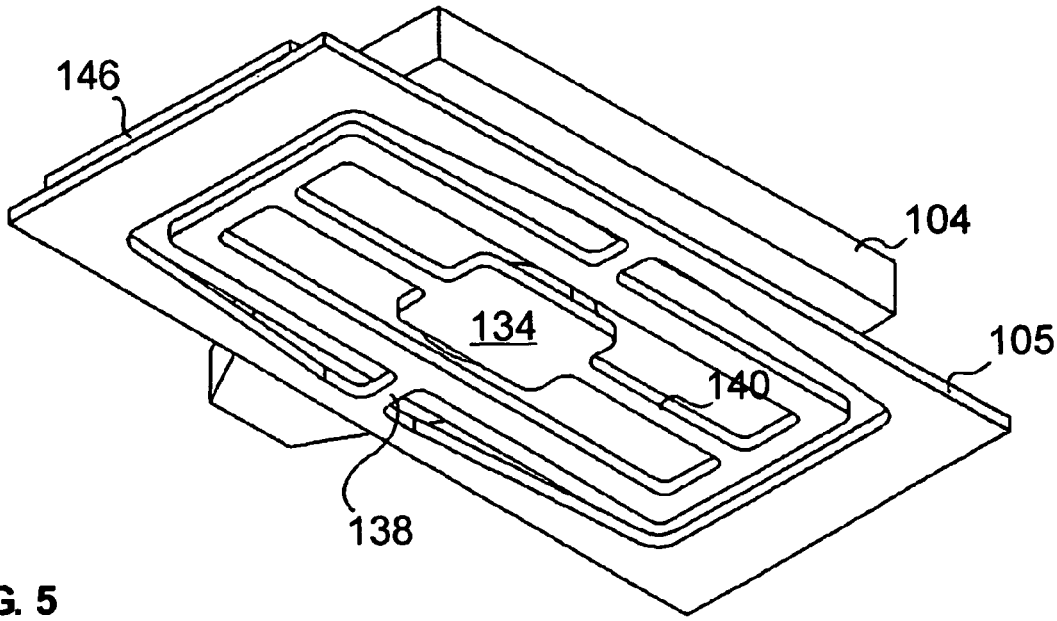
FIG. 5 is a view of the arrangement of FIG. 4 turned by 180°.

Various embodiments as described above may advantageously connect all three paths which are leading to one star point by means of one single triple contact bridge. To this end, on the contact bridge, which can be actuated dependent on the magnetic field induced by a magnetic coil, three electric contacts are provided. Thus, by means of one single control signal, the contact to all three phases can be established or disrupted. In an advantageous manner, this concept may ensure a symmetric handling of the current paths. In contrast thereto, this cannot be achieved by conventional solutions using one wire leading to a double bridge (form U, FIG. 9) or interconnecting two normally open relays of the form A (FIG. 8) or X (FIG. 10).

Moreover, the electric relay according to the present invention may lead to very short current paths. In view of the heat which has to be dissipated in case of high currents, this represents a decisive advantage over the conventional concepts. Only when using two conventional normally open bridge relays of the form X (FIG. 10), a similar effect could be achieved. Here, however, in one of the three connections four contact junctions would occur and double the dissipation power, thereby exceeding the allowed values.

Further, the bridge concept according to the present invention may cause a doubled effective contact distance and therefore can be used for 12 V, 24 V and also 42 V applications.

Finally, the electromagnetic relay according to the embodiments shown above may allow a significantly more compact assembly compared to conventional relays of a similar power class, thereby permitting same to be mounted directly at the motor to be switched.

According to an advantageous embodiment, the contact bridge has an essentially flat shape, whereby the electric contacts are arranged in one plane. Thereby a symmetric handling of all current paths can be realized in a particularly simple manner.

The advantageous properties of the electromagnetic relay according to the present invention can be utilized very effectively, when the contact system comprises three fixed contacts each of which corresponds to one of the three phases and wherein the contact bridge forms a star point of the three phases.

By integrating the yoke within the armature, which is moveable dependent on the magnetic field, a simplified two-part magnetic circuit is provided, that may ensure a particularly economic producibility, because on the one hand, one iron part is rendered unnecessary, and on the other hand, the assembly is simplified.

Such an armature can be actuated in a particularly efficient manner, when the core has an essentially T-shaped form with a longitudinal leg and two transversal legs forming a pole face, wherein the longitudinal leg extends axially through the magnetic coil, and when the armature encompasses the pole face essentially U-shaped, with a basal plane of the armature being oriented parallel to the pole face.

According to an advantageous embodiment, the contact bridge is arranged at the legs of the U-shaped armature in a manner, that it is essentially parallel to the pole face. Thus, it can be ensured that the forces which act on the three electric contacts are distributed symmetrically, and that, moreover, the force transmission from the magnetic system to the contact system is effected with low loss.

By providing a contact spring which extends essentially parallel to a plane which is defined by the electric contacts, an easy fabrication can be achieved, because bending of steel springs may lead to significant fabrication scattering. Moreover, a relaxation of the bending regions occurring at the high temperatures which are to be expected during operation can be avoided which otherwise would lead to changes of the characteristics during the life time of the electromagnetic relay.

A particularly economic and easy producibility at good functionality can be achieved by producing the contact spring out of metal, in particularly out of steel. The contact spring can for instance be fabricated by punching a sheet metal.

According to an advantageous embodiment, the contact spring is directly connected to the armature and the contact bridge is fixed at the contact spring in a manner, that the electric contacts pass through the contact spring when establishing an electric contact to the fixed contacts. Thus, the reset stiffness which is necessary for opening the contacts can be achieved in a particularly easy manner, because the contact bridge according to this embodiment is supported by the spring at several points and because the spring is arranged between the contact bridge and the fixed contacts.

According to an alternative embodiment, the contact bridge is arranged between the contact spring and the fixed contacts. This embodiment has the advantage of a further flexibility of the design of the contact spring, because no area has to be left clear for the electric contacts to pass through.

For this embodiment favorably an additional flat form spring is arranged between the contact bridge and the contact spring, in order to ensure that the contact spring has the necessary stiffness when the contacts are welded during an opening of the armature. The flat form spring can either be fixed between the contact bridge and the contact spring with a central opening at the outer ends of the contact spring in a manner, that the deflection of the contact spring is only possible in one direction. Alternatively; a flat form spring without opening may fixed centrally on the contact spring.

By providing a contact spring with an essentially triangular form having the electric contacts at the vertices of this triangle, an easy and economic producibility can be achieved with a simultaneous symmetrical handling of all contacts.

An enhanced mechanical stability can be achieved by providing a contact bridge with an essentially circular form and by arranging the electric contacts evenly distributed along the circumference of this circle.

According to an advantageous embodiment, the contact spring has an essentially rectangular flat form, wherein side webs which are provided at at least two sides of the rectangle form a frame, which can be connected with the armature and wherein at least one torsion web which extends from two opposing side webs and has one fixing point for the contact bridge. This embodiment of the contact spring is characterized in that the contact spring has a high spring stiffness for transmitting the contact forces in the direction of the movement (principle of the bilaterally fixed cantilever) and that at the same time by means of the torsion web a swivel joint with low resistance is realized, in order to allow almost equal contact forces which are independent of tolerances and contact burning. The torsion web can have different stiffness' according to its length and broadness.

By providing a broadened region of the torsion web in the area of the fixing point for the contact bridge, an improved force transmission to the contact bridge can be realized.

According to an advantageous embodiment this broadened region has cut-outs, so that the fixing is supported by a further torsion web which is perpendicular to the first torsion web. Thus, by two torsion webs which are lying in one plane, four swivel joints are realized, which ensure a symmetry of the contact forces in both space directions of this plane. According to the present embodiment, the contact bridge is fixed at the intersection point of the two torsion axes and the electric contacts are arranged in a manner, that one contact is lying within the axis of one torsion web having a particular distance to the section torsion web and that two further contacts are arranged in a manner that they are symmetric to the first torsion web but have half the distance to the second torsion web.

The contact spring can have different forms, for instance a rectangular form, where the torsion webs are extending parallel to the sides of the rectangle or a circular form, where the torsion webs are arranged radially.

Although in the previous text the moveable U-shaped structure 114 was always denominated as armature with a basal plane 116, according to an alternative conventional same can also be called a moveable yoke 114 with an integrated armature 116.

While the invention has been described with respect to the physical embodiments constructed in accordance therewith, it will be apparent to those skilled in the art that various modifications, variations and improvements of the present invention may be made in the light of the above teachings and within the purview of the appended claims without departing from the spirit and intended scope of the invention.

In addition, those areas in which it is believed that those ordinary skilled in the art are familiar have not been described herein in order to not unnecessarily obscure the invention described herein. Accordingly, it is to be understood that the invention is not to be limited by the specific illustrated embodiments, but only by the scope of the appended claims.

What is claimed is:

1. Electromagnetic relay, comprising;

an electromagnetic coil for exciting a magnetic field, a ferromagnetic circuit for guiding the magnetic field, wherein the magnetic coil encompasses at least a part of the ferromagnetic circuit and wherein the ferromagnetic circuit comprises a core, a moveable armature and a yoke, and a contact system with at least three moveable electric contacts which can be actuated dependent on the magnetic field, wherein:

the at least three electric contacts are arranged on a contact bridge, and the contact bridge is fixed at a contact spring in a manner, that the electric contacts pass through the contact spring when forming an electric connection to fixed contacts.

2. Electromagnetic relay according to claim 1, wherein the contact spring comprises a frame which can be connected to the yoke and at least one torsion web which extends through the inside of the frame and has a fixing point for the contact bridge.

3. Electromagnetic relay according to claim 2, wherein the frame has an essentially rectangular form, wherein at least two sides of the rectangle, side webs are arranged and wherein the torsion web extends between two opposing side webs.

4. Electromagnetic relay according to claim 2, wherein the frame has an essentially circular shape and that the torsion web extends radially through a center of the frame.

5. Electromagnetic relay according toclaim 2, wherein the torsion web comprises in the region of the fixing point for the contact bridge a broadened region.

6. Electromagnetic relay according to claim 5, wherein the torsion web comprises in the broadened region cut-outs, so that the fixing point is supported via a further torsion web which is orthogonal to the first torsion web.

7. Electromagnetic relay according to claim 1, wherein the contact bridge has an essentially flat form, so that the electric contacts are arranged within one plane.

8. Electromagnetic relay according to claim 1, wherein the contact system comprises three fixed contacts which correspond each to one of three phases and that the contact bridge forms a star point of the three phases.

9. Electromagnetic relay according to claim 1, wherein the yoke is moveable dependent on the magnetic field and that the armature is integrated within the yoke.

10. Electromagnetic relay according to claim 9, wherein the core has an essentially T-shaped form with a longitudinal leg and two transversal legs which form a pole face, wherein the longitudinal leg extends axially through the magnetic coil, and that the yoke encompasses the pole face essentially U-shaped, wherein a basal plane of the yoke being parallel to the pole face forms the armature.

11. Electromagnetic relay according to claim 10, wherein the contact bridge is arranged at the legs of the U-shaped yoke in a manner, that it is essentially parallel to the pole face.

12. Electromagnetic relay according to claim 1, wherein the contact spring has a flat form and is essentially parallel to a plane defined by the electric contacts.

13. Electromagnetic relay according to claim 12, wherein the contact spring is fabricated from metal, including steel.

14. Electromagnetic relay according to claim 1, wherein between the contact bridge and the contact spring a flat form spring is arranged.

15. Electromagnetic relay according to claim 1, wherein the contact bridge has an essentially triangular form and that the electric contacts are arranged at the vertices of this triangle.

16. Electromagnetic relay according to claim 1, wherein the contact bridge has an essentially circular shape and that the electric contacts are evenly distributed along a circumference.

17. Contact system for an electromagnetic relay with at least three moveable electric contacts, which can be actuated dependent on a magnetic system, wherein:

the at least three electric contacts are arranged on a contact bridge and the contact bridge is fixed at a contact spring in a manner, that the electric contacts pass through the contact spring when forming an electric connection to fixed contacts.

18. Contact system according to claim 17, wherein the contact bridge has an essentially flat form, so that the electric contacts are arranged within one plane.

19. Contact system according to claim 17, wherein the contact system comprises three fixed contacts which each correspond to one of three phases, and that the contact bridge forms a star point of the three phases.

20. Contact system according to claim 17, wherein between the contact bridge and the contact spring a flat form spring is arranged.

21. Contact system according to claim 17, wherein the contact bridge has an essentially triangular form and that the electric contacts are arranged at the vertices of this triangle.

22. Contact system according to claim 17, wherein the contact bridge has an essentially circular shape and that the electric contacts are evenly distributed along a circumference.

23. Contact system according to claim 17, wherein the contact spring comprises a frame which can be connected to the yoke and at least one torsion web which extends through the inside of the frame and has a fixing point for the contact bridge.

24. Contact system according to claim 23, wherein the frame has an essentially rectangular form, wherein at least two sides of the rectangle, side webs are arranged and wherein the torsion web extends between two opposing side webs.

25. Contact system according to claim 23, wherein the frame has an essentially circular shape and that the torsion web extends radially through a center of the frame.

26. Contact system according to claim 23, wherein the torsion web comprises in the region of the fixing point for the contact bridge a broadened region.

27. Contact system according to claim 26, wherein the torsion web comprises in the broadened region cut-outs so that the fixing point is supported via a further torsion web which is orthogonal to the first torsion web.

* * * * *